US008522520B2

(12) United States Patent
Smit et al.

(10) Patent No.: US 8,522,520 B2
(45) Date of Patent: Sep. 3, 2013

(54) YARN AND A PROCESS FOR MANUFACTURE THEREOF

(75) Inventors: Anton Eugene Smit, Boksburg (ZA); Ronald Douglas Sanderson, Stellenbosch (ZA)

(73) Assignee: Stellenbosch University, Stellenbosch (ZA)

( * ) Notice: Subject to any disclaimer, the term of this patent is extended or adjusted under 35 U.S.C. 154(b) by 415 days.

(21) Appl. No.: 12/515,513

(22) PCT Filed: Oct. 23, 2007

(86) PCT No.: PCT/IB2007/003177

§ 371 (c)(1), (2), (4) Date: May 31, 2011

(87) PCT Pub. No.: WO2008/062264

PCT Pub. Date: May 29, 2008

(65) Prior Publication Data

US 2011/0247311 A1 Oct. 13, 2011

(30) Foreign Application Priority Data

Nov. 20, 2006 (ZA) ..... 2006/09605
May 4, 2007 (ZA) ..... 2007/03634

(51) Int. Cl.
*D02G 3/22* (2006.01)

(52) U.S. Cl.
USPC ..... 57/200; 57/1 R; 57/362

(58) Field of Classification Search
USPC ..... 57/1 R, 200, 243, 362
See application file for complete search history.

(56) References Cited

U.S. PATENT DOCUMENTS

| | | | | |
|---|---|---|---|---|
| 692,631 | A | 2/1902 | Cooley | |
| 1,975,504 | A | 10/1934 | Formhals | |
| 2,109,333 | A | 2/1938 | Formhals | |
| 2,123,992 | A | 7/1938 | Formhals | |
| 2,187,306 | A | 1/1940 | Formhals | |
| 2,349,950 | A | 5/1944 | Formhals | |
| 6,106,913 | A * | 8/2000 | Scardino et al. | 428/36.3 |
| 2008/0170982 | A1 * | 7/2008 | Zhang et al. | 423/447.3 |

FOREIGN PATENT DOCUMENTS

| | | | |
|---|---|---|---|
| CN | 1687493 | | 10/2005 |
| CN | 1766181 | | 5/2006 |
| CN | 1776033 | | 5/2006 |
| WO | WO 2004/074559 | A1 | 9/2004 |
| WO | WO 2005/073442 | A1 | 8/2005 |
| WO | WO 2005/123995 | A1 | 12/2005 |
| WO | WO 2006/052039 | A1 | 5/2006 |
| WO | WO 2006/135147 | A1 | 12/2006 |

OTHER PUBLICATIONS

Teo et al., Electrospun fibre bundle made of aligned nanofibres over two fixed points, *Nanotechnology* 16:1878-1884 (2005).

(Continued)

*Primary Examiner* — Shaun R Hurley
(74) *Attorney, Agent, or Firm* — Knobbe Martens Olson & Bear LLP

(57) ABSTRACT

A yarn spun from a plurality of nano-fibers is provided and is characterized in that at least some of the nano-fibers are folded with the folds occurring at predeterminable distances which are integer multiples of a specific spacing. The folds result from spinning the nano-fibers onto a plurality of moving conductive strips which are inclined to their direction of movement. A process and apparatus for producing such yarn is also provided.

28 Claims, 5 Drawing Sheets

(56) References Cited

OTHER PUBLICATIONS

Li et al., Electrospinning of polymeric and ceramic nanofibers as uniaxially aligned arrays, *Nano Letters*, 3(8):1167-1171 (2003).
Katta et al., Continuous electrospinning of aligned polymer nanofibers onto a wire drum collector, *Nano Letters* 4(11):2215-2218 (2004).
Li et al., Electrospinning nanofibers as uniaxially aligned arrays and layer-by-layer stacked films, *Adv. Mater*. 16(4):361-366 (2004).
Ko et al., Electrospinning of continuous carbon nanotube-filled nanofiber yarns, *Adv. Mater*. 15(14):1161-1165 (2003).
Smit et al., Continuous yarns from electrospun fibers, *Polymer* 46:2419-2423 (2005).
Khil et al., Novel fabricated matrix via electrospinning for tissue engineering, *J Biomed Mater Res Part B: Appl Biomater* 72B:117-124 (2005).
International Search Report dated May 29, 2009, for PCT Application No. PCT/IB2007/003177, filed Oct. 23, 2007.

* cited by examiner

YARN AND A PROCESS FOR MANUFACTURE THEREOF

CROSS-REFERENCE TO RELATED APPLICATIONS

This application is a national phase of International Application No. PCT/IB2007/003177, filed Oct. 23, 2007, which claims the benefit of South African Patent Application No. 2006/09605, filed Nov. 20, 2006, and South African Patent Application No. 2007/03634, filed May 4, 2007, all of which are incorporated herein by reference in their entirety.

FIELD OF THE INVENTION

This invention relates to a yarn made from electrostatically spun fibres and a process for the manufacture of such a yarn.

BACKGROUND TO THE INVENTION

Electrostatic spinning of fibers was first described in U.S. Pat. No. 692,631. In principle, a droplet of polymer solution or melt is placed in a high electric field. The repulsion between the induced like-charges in the droplet compete with the surface tension of the liquid and when a sufficiently strong electric field is applied, typically 0.5-4 kV/cm, the electrostatic forces overcome the surface tension of the fluid and a jet of polymer solution or melt is ejected from the droplet. Electrostatic instability leads to rapid, chaotic whipping of the jet, leading in turn to fast evaporation of the solvent as well as stretching and thinning of the polymer fiber that is left behind. The formed fibers are then collected on a counter electrode, typically in the form of a nonwoven web. The collected fibers are usually quite uniform and can have fiber diameters of several micrometers, down to as low as 5 nm.

The three inherent properties of nano-fibrous materials that make them very attractive for numerous applications are their high specific surface area (surface area/unit mass), high aspect ratio (length/diameter) and their biomimicking potential. These properties lead to the potential application of electrospun fibres in such diverse fields as high-performance filters, absorbent textiles, fibre reinforced composites, biomedical textiles for wound dressings, tissue engineering scaffolding and drug-release materials, nano- and microelectronic devices, electromagnetic shielding, photovoltaic devices and high-performance electrodes, as well as a range of nano-fibre based sensors.

In many of these applications the alignment, or controlled orientation, of the electrospun fibres is of great importance and large-scale commercialisation of products can only become viable when sufficient control over fibre orientation is obtained at high production rates. In the past few years research groups around the world have been focusing their attention on obtaining electrospun fibres in the form of yarns of continuous single nano-fibres or uniaxial fibre bundles. Succeeding in this will allow the processing of nano-fibres by traditional textile processing methods like weaving, knitting and embroidery. This, in turn, will not only allow the significant commercialisation of several of the applications cited above, but will also open the door to many other exciting new applications. Incorporating nano-fibres into traditional textiles creates several opportunities. In the first instance, the replacement of only a small percentage of the fibres or yarns in a traditional textile fabric with yarns of similar diameter, but now made up of several thousands of nano-fibres, can significantly increase the toughness and specific surface area of the fabric without increasing its overall mass. Alternatively, the complete fabric can even be made from nano-fibre yarns. This has important implications in protective clothing applications, where lightweight, breathable fabrics with protection against extreme temperatures, ballistics, and chemical or biological agents are often required. On an aesthetic level, nano-fibre textiles also exhibit extremely soft handling characteristics and have been proposed for use in the production of artificial leather and artificial cashmere Several processes for preparing yarns from electrostatically spun fibers are described in the scientific and patent literature. Some of the oldest processes date back to the 1930s and are described in seven US patents by Anton Formhals. In U.S. Pat. No. 1,975,504, fibres are electrostatically spun from a cogwheel spinneret onto the edge of a rotating wheel or endless belt setup. The fibers that collect on the edge of the wheel or belt are pushed or pulled off and twisted into yarns. A very similar process with multiple rotating collectors and re-collectors are also described in PCT Application WO 2005/123995 A1.

U.S. Pat. No. 2,187,306 describes a process by which a core-spun yarn can be made by electrostatically spinning fibers onto a pre-formed yarn or sliver of fibers, while U.S. Pat. No. 2,109,333 describes a process in which electrostatically spun staple fibers can be made into a yarn.

In U.S. Pat. No. 2,349,950, corona discharge from the counter-electrode in the electrostatic spinning setup is used to neutralize charged fibers before collecting them and twisting into yarns.

Ko et al. (Advanced Materials, 2003, 15, 1161-1165) described a process by which a "self-assembled" yarn can be made from polyacrylonitrile/carbon nanotube blends.

Processes have been described by Kim (PCT Application WO 2004/074559 A1), Smit et al. (Polymer, 46, 2005, 2419-2423) and Khil et al. (J. Biomed. Mater. Res. B 72 (2005) 117), in which yarns are made by drawing electrostatically spun fiber webs across a water bath surface and collecting the resulting bundled fiber yarns. In a variation by Ramakrishna at el. at Singapore National University, fibers are spun onto a water bath with a hole in the bottom of the bath. The vortex, formed by the water running out of the hole, twists and aligns the fiber webs into an aligned fiber bundle yarn that is collected in continuous fashion from the hole in the bottom of the bath.

PCT Application WO 2005/073442 A1 describes a process in which a nonwoven web of electrostatically spun fibers is cut into ribbons, or the web is spun in thin ribbon strips from the start. The nonwoven ribbons are then twisted using an air twister to form continuous yarns.

In PCT Application WO 2006/052039 A1 a special electrostatic spinning collector belt is described, consisting of an endless-belt type collector with grooves parallel to the machine direction and with conductive strips in the grooves on the belt. Fibers are spun onto the conductive strips in the grooves, and then removed in a continuous fashion and twisted into yarns.

Chinese patents CN 1766181, CN1687493 and CN 1776033 describe essentially the same process, wherein fibers are spun from opposing directions, using high voltage of opposite polarity. The fibers that collide mid-air between the spinnerets of opposing polarity are neutralized and then collected on take-up rollers and twisted into yarns.

In PCT Application WO 2006-135147 A1, Kim describes a special configuration in which a C-shaped nozzle block containing thousands of spinning nozzles is placed adjacent to a drum collector rotating with high linear velocity. Narrow webs of reasonably aligned fibres are collected off the rotating drum surface in a continuous fashion and twisted together to form a continuous yarn.

The ideal process for preparing continuous yarns from electrostatically spun fibres should be up-scalable, result in high degrees of fibre alignment and work for all polymers and/or polymer blends that can be electrostatically spun into fibres. Although the processes described in the prior art comply with some of these requirements to varying degrees, not one of the processes fully complies with all three requirements.

The yarns obtained from the various processes described in the prior art invariably suffer from one or more drawbacks. In many cases, for example the processes described by Formhals, the obtained yarns have very low or random degrees of alignment of fibres along the yarn axis. Alignment of fibres is very important for yarn strength since it ensures an optimally shared distribution of the tensile load between the fibres when the yarn is placed under tension. In other words, lower degrees of fibre alignment lead to lower strength yarns. Another drawback of some of the processes, like Ko's self-assembled yarn, is that it is difficult or costly to scale-up the process. Finally, in cases where fibres are electrospun onto a water bath, yarns cannot be made from water-soluble or water-sensitive polymers. This can be a major drawback if one considers that many of the biodegradable polymers for tissue engineering applications are water-sensitive.

OBJECT OF THE INVENTION

It is an object of this invention to provide yarn and a process for producing such a yarn, which at least partially alleviates some of the abovementioned problems.

SUMMARY OF THE INVENTION

In accordance with this invention there is provided a yarn spun from a plurality of nano-fibres, characterized in that at least some of the nano-fibres are folded with the folds occurring at predeterminable distances.

Further features of the invention provide for the predeterminable distances to be integer multiples of at least one specific spacing; for at least some fibres to have a plurality of folds; and for the fibres to be substantially aligned in the same direction.

The invention also provides a process for producing a yarn which includes electrostatically spinning a plurality of fibres onto a plurality of moving conductive strips inclined to their direction of movement such that the fibres span at least some of the conductive strips, collecting the fibres from the conductive strips and forming the fibres into a yarn.

Further features of the invention provide for the conductive strips to be separated from each other by an insulating gap; for the insulating gap to be an air gap or to be filled with an insulating material; for the conductive strips to be parallel to each other; for the conductive strips to be spaced apart at predetermined, preferably equal, distances; and for the spacing between conductive strips to be between 1 μm and 300 mm.

Still further features of the invention provide for the conductive strips to be inclined between 5° and 175° to their direction of movement, preferably 90° to their direction of movement; for the conductive strips to have a uniform thickness, preferably between 100 nm and 30 mm; for the conductive strips to be held at electric ground potential or at a potential with opposite polarity to that of the electrostatic spinning source; and for the distance between the electrostatic spinning source and the conductive strips to be uniform, preferably between 0.5 mm and 500 mm.

Yet further features of the invention provide for the spinning to occur bottom-up with the electrostatic spinning source below the conductive strips, alternatively in a top-down or side-by-side fashion; for the fibres to be formed into a yarn by mechanical or electrostatic means; and for the yarn to be collected on a take-up roller.

The invention still further provides apparatus for producing a yarn including an electrostatic spinning source and a plurality of conductive strips arranged to collect fibres from the spinning source and movable with respect thereto and a web collector and a web twister arranged in series therewith, characterized in that the conductive strips are inclined to their direction of movement.

Further features of the invention provide for the conductive strips to be carried on a moving surface; for the surface to include a belt, a pair of belts spaced apart or drum; for the conductive strips to be insulated from each other; for the conductive strips to be parallel to each other; for the conductive strips to be equally spaced apart; and for the spacing between conductive strips to be between 1 μm and 300 mm.

Still further features of the invention provide for the conductive strips to be inclined between 5° and 175° to their direction of movement, preferably 90° to their direction of movement; for the conductive strips to have a uniform thickness, preferably between 100 nm and 30 mm; for the conductive strips to be held at electric ground potential; and for the distance between the electrostatic spinning source and the conductive strips to be uniform, preferably between 0.5 mm and 500 mm.

BRIEF DESCRIPTION OF THE DRAWINGS

The invention will be described, by way of example only, with reference to the drawings in which.

DETAILED DESCRIPTION OF THE DRAWINGS

Figure 1:
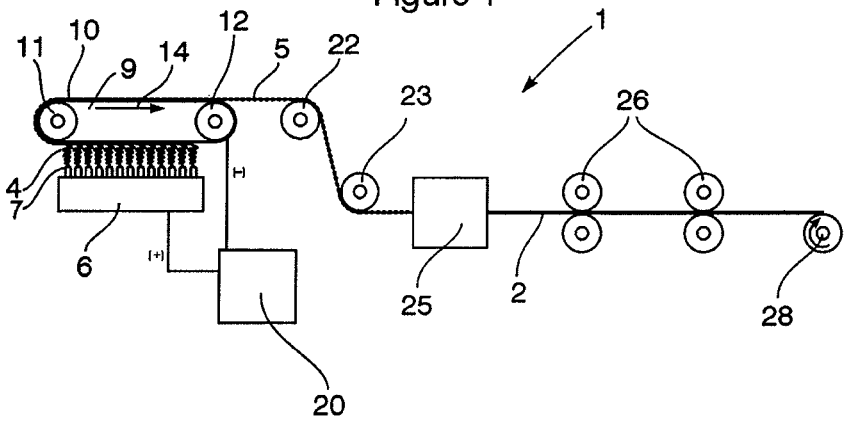
FIG. 1 is a schematic diagram of apparatus for producing a yarn.

Apparatus (1) for producing a yarn (2) from nano-fibres is shown in FIGS. 1 to 5 and includes an electrostatic spinning source (6) having a plurality of electrostatic spinning jets (4) with a fibre collector (9) spaced apart therefrom. In this embodiment the spinning source (6) is located 100 mm below the collector (9). However, any suitable orientation could be used, including a top-down or side-by-side orientation, with a separating distance of between 0.5 mm and 500 mm.

The electrostatic spinning source (6) makes use of a traditional needle-based spinning apparatus, but could also use a multiple-needle setup, needleless spinning techniques, or any other electrostatic fibre-forming process. The apparatus (1) thus far described is of fairly conventional configuration.

Figure 2:
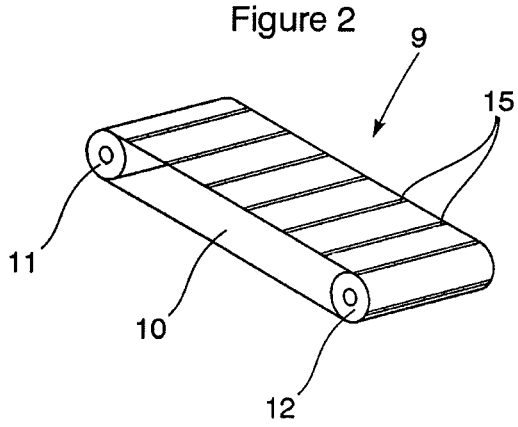
FIG. 2 is a perspective view of the fibre collector of the apparatus in FIG. 1.
Figure 3:
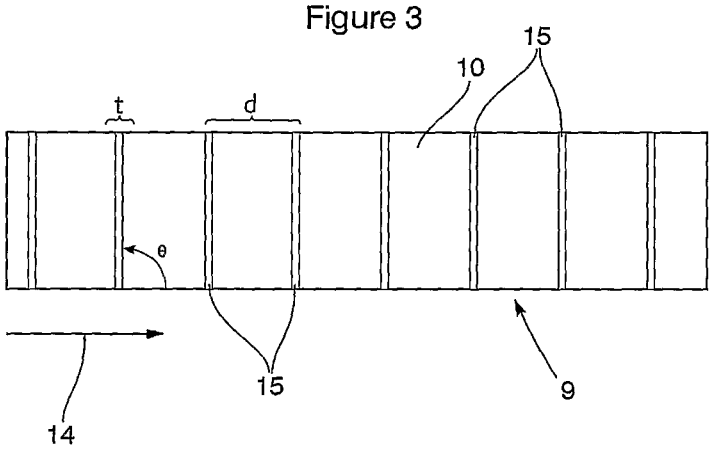
FIG. 3 is a top plan view of the collector in FIG. 2.

As shown in FIGS. 2 and 3, the collector (9) includes an endless belt (10) supported between a pair of rollers (11, 12). One of the rollers (12) is driven so that the top of the belt (10) moves in the direction of the arrow (14).

According to the invention, the belt (10) has a plurality of conductive strips (15) thereon inclined at angle (θ) to its length, and hence the direction of movement of the belt (10). The conductive strips (15) are made from copper and each has a thickness (t) of between 100 nm and 30 mm. In this embodiment the thickness (t), or width, of each is uniform and is 1 mm (but shown on an exaggerated scale for illustrative purposes). The material of the belt (10), in this embodiment a rubber-like material, insulates the conductive strips (15) from each other along their length. However, the ends of the conductive strips (15) are conductively connected and maintained at ground potential.

The inclination (θ) of the conductive strips (15) to the direction of movement of the belt (10) is between 5° and 175° and the distance (d) between each between 1 μm and 300 mm. In this embodiment the conductive strips (15) are parallel to each other and are inclined at 90° to the direction of movement of the belt (10) with a distance (d) of 10 mm between each. Also in this embodiment, the conductive strips (15) are of uniform height.

An electric potential (20) is applied in conventional fashion between the nozzles (7) and conductive strips (15). In this embodiment the conductive strips (15) are held at electric ground potential.

The belt (10) feeds onto web collector rollers (22, 23), which in turn feed into a web twister (25). Drawing rollers (26) and a take-up roller (28) are located after the twister (25) in conventional fashion.

Figure 4:
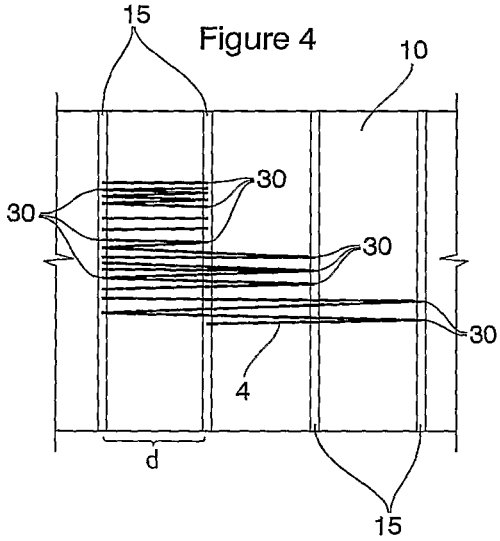
FIG. 4 is a top plan view of part of the collector in FIG. 2 in use.
Figure 5:
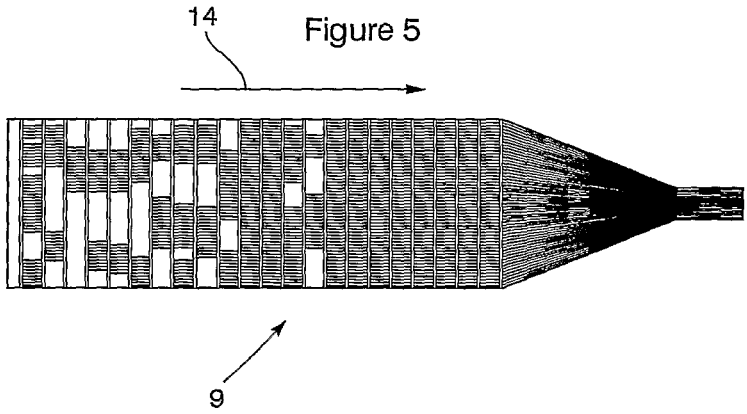
FIG. 5 is a top plan view of the collector in FIG. 2 in use.

In use, nano-fibres (4) are electrostatically drawn to the conductive strips (15). As shown in FIGS. 4 and 5, the fibres (4) each tend to span a pair or a number of adjacent conductive strips (15) by folding between these. The distance between each fold (30) for a fibre thus corresponds to the predetermined distance (d) between the conductive strips (15) and will either be equal to (d) or an integer multiple of (d).

The fibres (5) collected on the belt (10) are drawn off in conventional fashion by the web collector rollers (22, 23) and fed into the web twister (25), which forms the fibres (5) into a yarn (2). The drawing rollers (26) stretch the yarn (2) before it is collected on the take-up roller (28).

Figure 6:
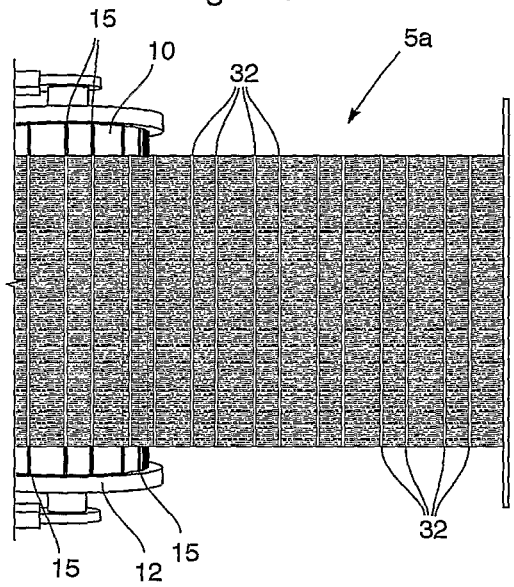
FIG. 6 is a top plan view a pre-yarn web produced by the collector in FIG. 2.

The pre-yarn web (5*a*) prior to being fed in to the web twister (25) is shown in FIG. 6 and has the appearance of a sheet formed by a plurality of fibres which extend substantially in the direction of travel of the belt (10). The location of the folds (30) in the fibres which correspond to the conductive strips (15) are clearly visible as parallel lines (32) of high fibre density across the width of the web (5*a*).

Figure 8:
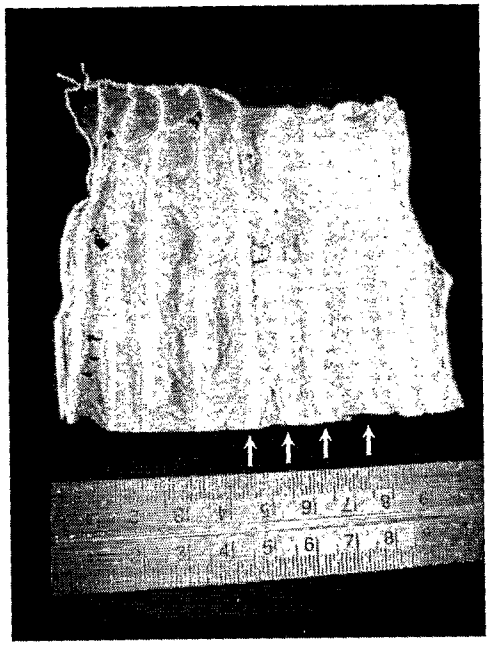
FIG. 8 is a photograph of an unravelled section of yarn.

This is also apparent from the photograph in FIG. 8 which shows a section of yarn which has been unravelled. The arrows indicate lines of higher fibre density which are caused by the folds in the fibres and which correspond to the conductive strips. The width of the higher density lines is determined by the thickness of the conductive strips on the collector. Even with conductive strips that are only 0.5 mm thick these lines are clearly visible to the naked eye. The presence of these lines gives a clear indication that yarn was made using the process of the invention.

It will be appreciated that the fibres will generally not simply fold back on themselves to form a neat 180° bend but rather that each fold may be somewhat chaotic given the extremely thin diameter of each fibre compared to the thickness of the conductive strips and the rate at which the fibres are being produced (often in the order of kilometers per minute). Thus each fold may include a number of random loops or other random patterns which increases the fibre density at each conductive strip.

Figure 7:
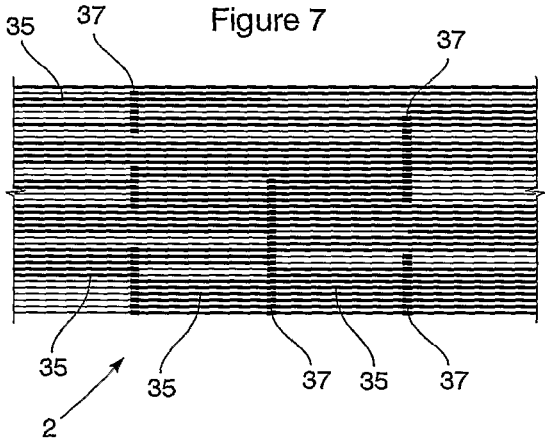
FIG. 7 is a side elevation of part of a yarn produced using the apparatus in FIG. 1.

An enlarged view of part of a yarn (2) produced by the apparatus (1) is shown in FIG. 7. The folded fibres (35) are clearly visible with the folds (37) spaced the distance (d) or an integer multiple thereof apart. The spacing of the folds (37) is predeterminable as it reflects the spacing of the conductive strips (15). Importantly, the fibres are also uniformly oriented in the direction of the length of the yarn.

It has been found that the area where these folds occur is relatively large compared to the typical scale used in, for example, scanning electron microscopy (SEM) and are generally visible to the naked eye or under an optical microscope. However, SEM may be required to identify these lines in cases where the conductive strips are extremely thin and spaced very close to each other.

Figure 9:
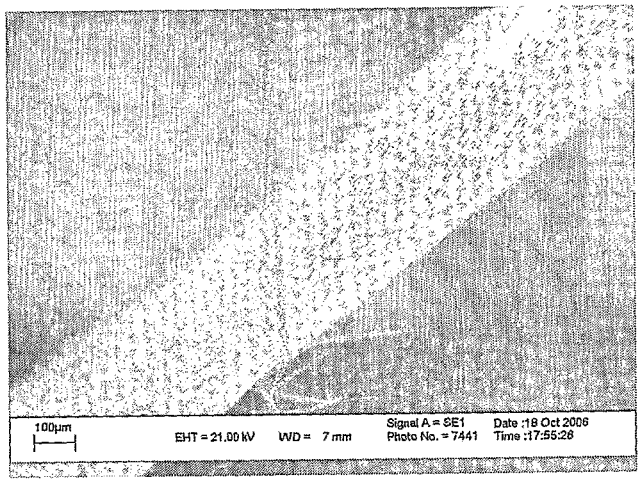
FIG. 9 is a scanning electron microscope (SEM) image of a yarn produced by the process.

A SEM image of a yarn produced by the process is shown in FIG. 9. From this it will be noted that fibres show a high degree of alignment, much more so than with prior art industrial processes.

The alignment of the fibres in the yarn and the presence of regularly spaced folds in the fibres not only ensure easy identification of yarns produced by this process but also provide a yarn which is strong and is uniformly reproducible. These are surprising results from an apparently simple variation to known processes for producing nano-fibre yarns.

It will be appreciated that many other processes and apparatuses exist which fall within the scope of the invention. For example, the conductive strips could be carried in any suitable manner, including on a rotating drum. Further alternately, the conductive strips could be secured by their ends between a pair of belts to have a ladder-like configuration with the conductive strips separated from each other by an air gap. The conductive strips could be separated by any suitable insulating material and need not be evenly spaced, parallel or of the same thickness. The conductive strips, being elongate conductive surfaces, can have any suitable configuration and could be made of any suitable material. For example, the conductive strips could be wire-like or tape-like or even provided by the edge of a plate or similar element.

Clearly, the folds in the fibres found in the yarn will reflect the spacing of the conductive strips and will be predetermined by this spacing. Also, the spacing will be found to repeat itself in the length of the yarn as the conductive strips move into and out of alignment with the electrostatic spinning fiber source.

The electrostatic spinning source and fibre collector could be configured in any suitable manner, including for upward and sideward spinning, and any suitable number and configuration of spinning nozzles or needle-less sources can be used.

Also, any suitable material, or combination of materials, can be used for making the nano-fibres.

The invention claimed is:

1. A yarn spun from a plurality of nano-fibres, consisting essentially of nano-fibres that are folded with the folds occurring at predeterminable distances.

2. The yarn as claimed in claim 1 wherein the predeterminable distances are integer multiples of at least one specific spacing.

3. The yarn as claimed in claim 1 wherein at least some fibres have a plurality of folds.

4. The yarn as claimed in claim 1 wherein the fibres are aligned in substantially the same direction.

5. A process for producing a yarn which includes electrostatically spinning a plurality of fibres onto a plurality of moving conductive strips inclined to their direction of movement such that the fibres span at least some of the conductive strips, collecting the fibres from the conductive strips to form a web of fibres, and forming the web of fibres into a yarn.

6. The process as claimed in claim 5 wherein the conductive strips are separated from each other by an insulating gap.

7. The process as claimed in claim 6 wherein the insulating gap is an air gap or a gap filled with an insulating material.

8. The process as claimed in claim 5 wherein the conductive strips are parallel to each other.

9. The process as claimed in claim 5 wherein the conductive strips to be are spaced apart at predetermined distances.

10. The process as claimed in claim 9 wherein the predetermined distances are equal.

11. A process as claimed in claim 9 for producing a yarn, comprising:

electrostatically spinning a plurality of fibres onto a plurality of moving conductive strips inclined to their direction of movement such that the fibres span at least some of the conductive strips, wherein the conductive strips are spaced apart at predetermined distances, and wherein the spacing between conductive strips is between 1 μm and 300 mm;

collecting the fibres from the conductive strips; and forming the fibres into a yarn.

12. The process as claimed in claim 5 wherein the conductive strips are inclined between 5° and 175° to their direction of movement.

13. The process as claimed in claim 12 wherein the conductive strips are inclined 90° to their direction of movement.

14. The process as claimed in claim 5 wherein the conductive strips have a uniform thickness.

15. A process for producing a yarn, comprising:

electrostatically spinning a plurality of fibres onto a plurality of moving conductive strips inclined to their direction of movement such that the fibres span at least some of the conductive strips, wherein the conductive strips have a uniform thickness of between 100 nm and 30 mm;

collecting the fibres from the conductive strips; and forming the fibres into a yarn.

16. A process as claimed in claim 5 for producing a yarn, comprising:

electrostatically spinning a plurality of fibres onto a plurality of moving conductive strips inclined to their direction of movement such that the fibres span at least some of the conductive strips, wherein the conductive strips are held at electric ground potential or at a potential with opposite polarity to that of the electrostatic spinning source;

collecting the fibres from the conductive strips; and forming the fibres into a yarn.

17. The process as claimed in claim 16 wherein a distance between the electrostatic spinning source and the conductive strips is between 0.5 mm and 500 mm.

18. The process as claimed in claim 5 wherein the fibres are formed into a yarn by mechanical or electrostatic means.

19. An apparatus for producing a yarn including an electrostatic spinning source and a plurality of conductive strips arranged to collect fibres from the spinning source and movable with respect thereto and a web collector and a web twister arranged in series therewith, wherein the conductive strips are inclined to their direction of movement.

20. The apparatus as claimed in claim 19 wherein the conductive strips are carried on a moving surface.

21. The apparatus as claimed in claim 20 wherein the surface is selected from a belt, drum and a pair of belts spaced apart.

22. The apparatus as claimed in claim 19 wherein the conductive strips are parallel to each other.

23. The apparatus as claimed in claim 19 wherein the conductive strips are equally spaced apart.

24. An apparatus for producing a yarn, comprising:

an electrostatic spinning source; and a plurality of conductive strips arranged to collect fibres from the spinning source and movable with respect thereto and a web collector and a web twister arranged in series therewith, wherein the conductive strips are inclined to their direction of movement, wherein the conductive strips are equally spaced apart, and wherein a spacing between conductive strips is between 1 μm and 300 mm.

25. The apparatus as claimed in claim 19 wherein the conductive strips are inclined between 5° and 175° to their direction of movement.

26. The apparatus as claimed in claim 25 wherein the conductive strips are inclined 90° to their direction of movement.

27. An apparatus for producing a yarn, comprising:

an electrostatic spinning source; and a plurality of conductive strips arranged to collect fibres from the spinning source and movable with respect thereto and a web collector and a web twister arranged in series therewith, wherein in that the conductive strips are inclined to their direction of movement, and wherein the conductive strips have a thickness between 100 nm and 30 mm.

28. The process as claimed in claim 5 wherein the conductive strips are inclined 90° to their direction of movement.

* * * * *

UNITED STATES PATENT AND TRADEMARK OFFICE

CERTIFICATE OF CORRECTION

PATENT NO. : 8,522,520 B2
APPLICATION NO. : 12/515513
DATED : September 3, 2013
INVENTOR(S) : Smit et al.

It is certified that error appears in the above-identified patent and that said Letters Patent is hereby corrected as shown below:

In the Claims

In column 7 at line 10, In Claim 9, after "strips" delete "to be".

In column 7 at line 13, In Claim 11, after "A process" delete "as claimed in claim 9".

In column 7 at line 39, In Claim 16, after "A process" delete "as claimed in claim 5".

Signed and Sealed this
First Day of July, 2014

Michelle K. Lee

Michelle K. Lee
*Deputy Director of the United States Patent and Trademark Office*